US006023132A

United States Patent [19]

Crouse et al.

[11] Patent Number: 6,023,132

[45] Date of Patent: Feb. 8, 2000

[54] ELECTRONIC BALLAST DERIVING AUXILLIARY POWER FROM LAMP OUTPUT

[75] Inventors: Kent E. Crouse, Hanover Park; Peter W. Shackle, Arlington Heights; Patrick J. Keegan, Schaumburg; Ronald J. Bezdon, Antioch, all of Ill.

[73] Assignee: Energy Savings, Inc., Schaumburg, Ill.

[21] Appl. No.: 09/170,144

[22] Filed: Oct. 12, 1998

Related U.S. Application Data

[62] Division of application No. 08/879,181, Jun. 20, 1997.

[51] Int. Cl.[7] ..... H05B 37/02

[52] U.S. Cl. ..... 315/307; 315/209 R; 315/224; 315/DIG. 4

[58] Field of Search ..... 315/224, 307, 315/206, 209 R, DIG. 5, 225, 127

[56] References Cited

U.S. PATENT DOCUMENTS 5,500,576 3/1996 Russell et al. ..... 315/307

5,808,422 9/1998 Venkitasubrahmanian et al. ... 315/225

*Primary Examiner*—David H. Vu

*Attorney, Agent, or Firm*—Paul F. Wille

[57] ABSTRACT

An ballast includes a variable frequency boost circuit and a driven half-bridge inverter having a series resonant, direct coupled, parallel output. A control circuit includes a variable frequency driver section, a multivibrator section, and a sensing section. The variable frequency driver changes frequency smoothly, i.e. without discontinuities. The multivibrator section acts as a switch that is enabled or disabled by the sensing section for controlling the frequency of the inverter. Lamp current is required for continued operation of the control circuit. The multivibrator section controls starting by causing the inverter to produce an output signal having a trapezoidal envelope. In the event of an arc, the control circuit quenches the arc and the multivibrator periodically pulses the lamp to attempt to re-start the lamp.

12 Claims, 2 Drawing Sheets

ELECTRONIC BALLAST DERIVING AUXILLIARY POWER FROM LAMP OUTPUT

CROSS-REFERENCE TO RELATED APPLICATION

This application is a division of application Ser. No. 08/879,181, filed Jun. 20, 1997.

BACKGROUND OF THE INVENTION

This invention relates to electronic ballasts for gas discharge lamps and, in particular, to a compact ballast for instant start fluorescent lamps.

A fluorescent lamp is a non-linear electrical load, i.e. the current through the lamp is not proportional to the voltage across the lamp. The current is zero until the voltage increases sufficiently for an arc to strike, then the current will increase rapidly through the ionized gases in the lamp unless there is a ballast in series with the lamp to limit current.

In some fluorescent lamps, small filaments at each end of the lamp are made to glow and emit electrons to facilitate starting the lamp. Lamps without these filaments, or "heaters," are called "instant start" lamps because there is no delay while the filaments are heated. An instant start lamp must be started at a higher voltage and current than a lamp with heaters, which requires that the electronic ballasts for such lamps be more powerful and, to some extent, more dangerous.

A "magnetic" ballast is an inductor in series with a lamp for limiting current through the lamp. The inductor includes many turns of wire wound on a laminated iron core and magnetic ballasts of the prior art are physically large and heavy, often accounting for more than half the weight of a fixture including the lamps.

An "electronic" ballast typically includes a converter for changing the AC from a power line to direct current (DC) and an inverter for changing the DC to high frequency AC. Converting from AC to DC is usually done with a full wave, or bridge, rectifier. A filter capacitor on the output of the rectifier stores energy for powering the inverter. Some ballasts include a "boost" circuit to improve power factor or to increase the voltage on the filter capacitor from approximately 140 volts to 300 volts or higher (from a 120 volt AC input). The inverter changes the DC to high frequency AC at 140–300 volts for powering one or more fluorescent lamps.

Because electronic ballasts operate at a higher frequency than a power line (e.g. 30 khz compared to 50/60 hz), the "magnetics" in an electronic ballast are much smaller than the inductor in a magnetic ballast. Despite the smaller inductors, an electronic ballast is capable of delivering a significant amount of power, at least for a short time, in order to start an instant start lamp. Therein lies a problem because, if a lamp is defective or missing, a ballast for an instant start lamp can produce a significant arc and may cause a fire.

An electronic ballast is not intended to be operated without a lamp. If a lamp is not connected to the ballast, or if a lamp is defective, then the voltage on the sockets for the lamp can greatly exceed 300 volts. This creates a potentially hazardous situation for anyone who may come into contact with a socket or who may be near the arc created by ballasts of the prior art.

One solution to this problem is to use a transformer for coupling power to a lamp, thereby isolating the sockets from ground and from the fixture for the lamp. An output transformer is undesirable for reasons of size, weight, and cost, even for a transformer operating at the higher frequency of an electronic ballast.

U.S. Pat. No. 5,500,576 (Russell et al.) discloses a very compact ballast operating at high efficiency, excellent power factor and including fault detection circuitry. That ballast, as described, can not operate with instant start lamps or operate other lamps in instant start mode. An instant start lamp requires a large impulse of energy to start and such an impulse from the patented ballast would be sensed as a fault, turning off the ballast.

Instant start electronic ballasts have become a low cost means for ballasting what are known as T8 lamps, even though these lamps include heaters. Most instant start ballasts include a current fed, push-pull, parallel resonant circuit. While this circuit is relatively simple to design and produce, it has several disadvantages. One disadvantage is the relatively large current circulating in the resonant circuit. While useful for starting an instant start lamp, the circulating current leads to power losses and low efficiency. Another disadvantage of conventional instant start ballasts of the prior art is the bulky output transformer. A further disadvantage is that, when lamps start rectifying at the end of their life, the heaters can glow as brightly as the filament in an incandescent lamp, producing very high temperatures.

It is known in the art to provide an electronic ballast having a direct coupled output, in which a lamp is connected in parallel with the capacitor in a series resonant LC circuit. Such ballasts require additional circuitry to sense fault conditions, such as a missing or defective lamp, and to shut off the ballast. A problem with fault detection circuitry is the power consumed when the lamp is operating normally, i.e. adding fault detection circuitry can decrease the efficiency of a ballast. Another problem with fault detection circuitry is that it is difficult to tell the difference between a fault condition and normal starting in an instant start lamp.

U.S. Pat. 5,574,336 (Konopka et al.) discloses a ballast for a fluorescent lamp in which an inverter is turned on or off by a control circuit that is turned on or off by a timing circuit that is coupled to the lamp. If lamp current is not detected within a short period of starting, the timing circuit turns off the control circuit, which turns off the inverter. If lamp current is detected, then the inverter continues to run and provides power to the lamp and to the control circuit.

In view of the foregoing, it is therefore an object of the invention to provide an improved compact ballast for instant start lamps and for lamps with heaters but operated as instant start lamps.

Another object of the invention is to provide an instant start ballast having more efficient operation and improved fault detection.

A further object of the invention is to provide an instant start ballast that does not have a transformer output or a parallel resonant circuit.

Another object of the invention is to provide an instant start ballast that can suppress in a few hundred milliseconds, or less, an arc external to the lamp due to a faulty connection.

A further object of the invention is to provide an instant start ballast that can distinguish between a fault and normal starting.

Another object of the invention is to provide an instant start ballast that automatically reduces power at the end of the life of the lamp.

SUMMARY OF THE INVENTION

The foregoing objects are achieved in this invention in which a ballast includes a high voltage portion and a low voltage portion. The high voltage portion includes a converter, having a variable frequency boost circuit, and a driven half-bridge inverter having a series resonant, direct coupled, parallel output. The low voltage portion of the ballast includes a control circuit having a variable frequency driver section, a multivibrator section, and a sensing section. The multivibrator section acts as a switch that is enabled or disabled by the sensing section for controlling the frequency of the inverter. Lamp current is required for operation of the control circuit, which terminates operation within one hundred milliseconds when a fault is detected. The multivibrator section controls starting by causing the inverter to produce an output signal having a trapezoidal envelope.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
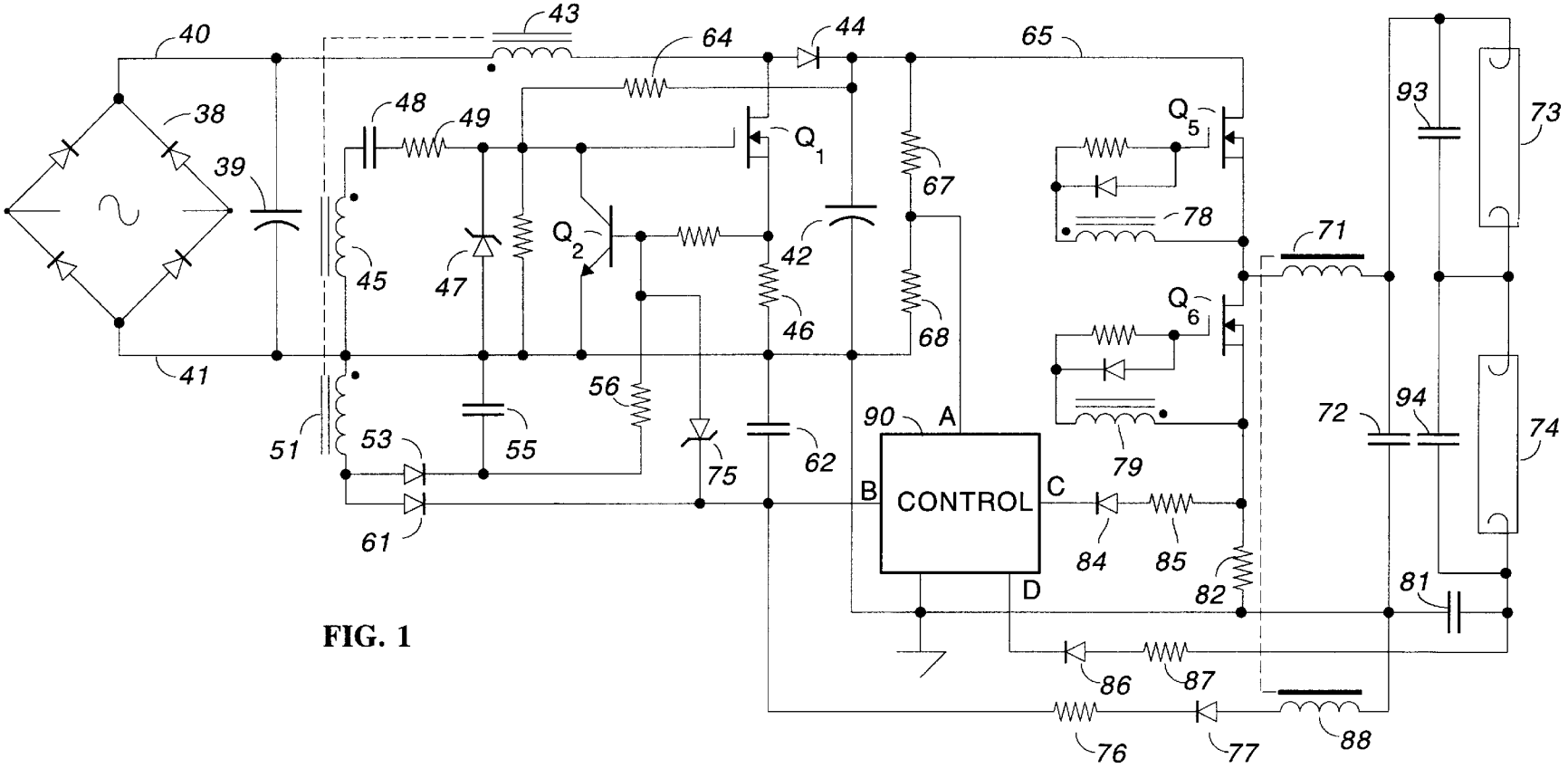
FIG. 1 is a schematic of a ballast constructed in accordance with a preferred embodiment of the invention.

In FIG. 1, the AC input of the ballast includes bridge rectifier 38 having DC output terminals connected to capacitor 39 by rails 40 and 41. When transistor $Q_1$ is conducting, current flows from rail 40 through inductor 43 and transistor $Q_1$ to rail 41 through current sensing resistor 46. When transistor $Q_1$ stops conducting, the field in inductor 43 collapses and the inductor produces a high voltage that adds to the voltage from bridge rectifier 38 and is coupled through diode 44 to capacitor 42. Diode 44 prevents current from flowing back to transistor $Q_1$ from capacitor 42.

Although illustrated as a single transistor, transistor $Q_1$ can represent two or more transistors in parallel to provide sufficient current capability in the boost circuit to produce high voltages. In order to provide a large energy impulse for instant start, the boost circuit is typically more powerful than in other ballasts in order to provide sufficient energy during the starting impulse. For example, a ballast for a lamp with heaters may have a sixty watt boost circuit whereas a ballast for an instant start lamp with the same nominal wattage might have a boost capable of one hundred watts output. Peripheral circuitry limits the output of the boost except during starting. The boost runs at normal power during normal operation.

Inductor 45 is magnetically coupled to inductor 43 and provides feedback to the gate of transistor $Q_1$, causing transistor $Q_1$ to oscillate at high frequency, e.g. 40–150 khz. Resistor 46, in series with the source-drain path of transistor $Q_1$, provides a feedback voltage that is coupled to the base of transistor $Q_2$. The current through inductor 43 is controlled by the voltage drop across resistor 46. When the voltage on resistor 46 reaches a predetermined magnitude, transistor $Q_2$ turns on, turning off transistor $Q_1$. Resistor 46 has a small value, e.g. 0.5 ohms. Zener diode 47 limits the voltage on the gate of transistor $Q_1$ from inductor 45. Capacitor 48 and resistor 49 provide pulse shaping for the signal to the gate of transistor $Q_1$ from inductor 45.

Inductor 51 is magnetically coupled to inductors 43 and 45. The voltage induced in inductor 51 therefore includes a high frequency component from the operation of transistor $Q_1$ and a low frequency component from the ripple voltage. The voltage from inductor 51 is coupled to a ripple detector including diode 53 and capacitor 55. The rectified voltage on capacitor 55 is coupled to the control electrode of transistor $Q_2$ by resistor 56. This portion of the circuit significantly improves power factor and harmonic distortion by varying the duty cycle of transistor $Q_1$ in phase with the ripple voltage on capacitor 39.

The boost circuit provides both low voltage, e.g. twenty-five volts, for powering other components of the ballast, and high voltage, e.g. 300 volts, for powering one or more lamps. Diode 61 is connected to inductor 51 and capacitor 62 connected between diode 61 and rail 41. The junction between diode 61 and capacitor 62 is connected by line B to control circuit 90, supplying a filtered, DC voltage, e.g. twenty-five volts, for powering the control circuit.

Resistor 64, connected between high voltage rail 65 and the gate of transistor $Q_1$, provides a DC path through the boost circuit for causing the boost circuit to begin oscillation, i.e. the boost circuit is self-oscillating. Resistor 64 has a high resistance, e.g. 660,000 ohms, and is of negligible effect once the boost circuit is oscillating. The boost circuit oscillates during each half cycle of the rectified input voltage, i.e. the boost circuit restarts 120 times per second with the bias provided from resistor 64. Line A samples the voltage on rail 65 and couples a fraction of the voltage, determined by the values of resistors 67 and 68, to control circuit 90.

Transistors $Q_5$ and $Q_6$ are connected in series between high voltage rail 65 and common rail 41 through current sensing resistor 82. One side of inductor 71 is connected to the junction of transistors $Q_5$ and $Q_6$. Capacitor 72 is connected between the other side of inductor 71 and common, forming a series resonant LC circuit. Lamp 73 and lamp 74 are connected in series across resonant capacitor 72. Transistors $Q_5$ and $Q_6$ alternately conduct at a frequency determined by control circuit 90, which is magnetically coupled to transistors $Q_5$ and $Q_6$ by inductors 78 and 79.

By-pass capacitor 93 is connected in parallel with lamp 73 and by-pass capacitor 94 is connected in parallel with lamp 74. These capacitors act as a starting aid and, in accordance with the invention, are part of the arc detection circuitry by providing a path to capacitor 81 if a lamp should become disconnected. Only one capacitor is really needed for starting. The second capacitor can be much smaller and yet provide a sufficiently low impedance for arc detection. In one embodiment of the invention, capacitor 93 had a value of 47 pf whereas capacitor 94 had a value of 470 pf.

Lamp current, e.g. 180 ma., flows through inductor 71. In accordance with one aspect of the invention, inductor 88 is magnetically coupled to resonant inductor 71. The output from inductor 88 is rectified by diode 77, current limited by resistor 76 and coupled to capacitor 62. Thus, both the boost circuit and the output circuit provide power for control circuit 90. The voltage on capacitor 62 is limited by Zener diode 75. If Zener diode 75 conducts, transistor $Q_2$ is forward biased and the boost circuit is shut off. Even if the boost circuit is shut off and the ballast is operating in its starting sequence, inductor 88 can provide sufficient power for control circuit 90.

Capacitor 81 is connected in series with lamps 73 and 74 across resonant capacitor 72. The voltage drop across capacitor 81 is coupled by diode 86 and resistor 87 to input D of control circuit 90. When lamps 73 and 74 are connected to the ballast and the ballast is operating normally, the voltage across capacitor 81 is approximately one-half the voltage between rail 65 and rail 41. In the absence of a lamp, or if a lamp is defective, then the voltage across capacitor 81 is considerably lower or zero. This low voltage is detected by control circuit 90 and the ballast is shut-off.

Capacitor 81 serves two functions. It blocks DC through the lamps and acts as a sensor for lamp failure or removal. In either function, capacitor 81 dissipates essentially no power and enhances the efficiency and safety of the ballast.

Resistor 82 is in series with transistors $Q_5$ and $Q_6$ and converts the current through transistor $Q_6$ to a voltage that is coupled to input C by diode 84 and resistor 85. An excessively high voltage across resistor 82 causes the ballast to shut off. Resistor 82 has a low resistance, e.g. 0.1–10 ohms, and dissipates little power. Excessive lamp current will cause a high voltage across resistor 82 that is coupled through input C to control circuit 90 to increase the frequency of the inverter, thereby decreasing the output voltage.

Figure 2:
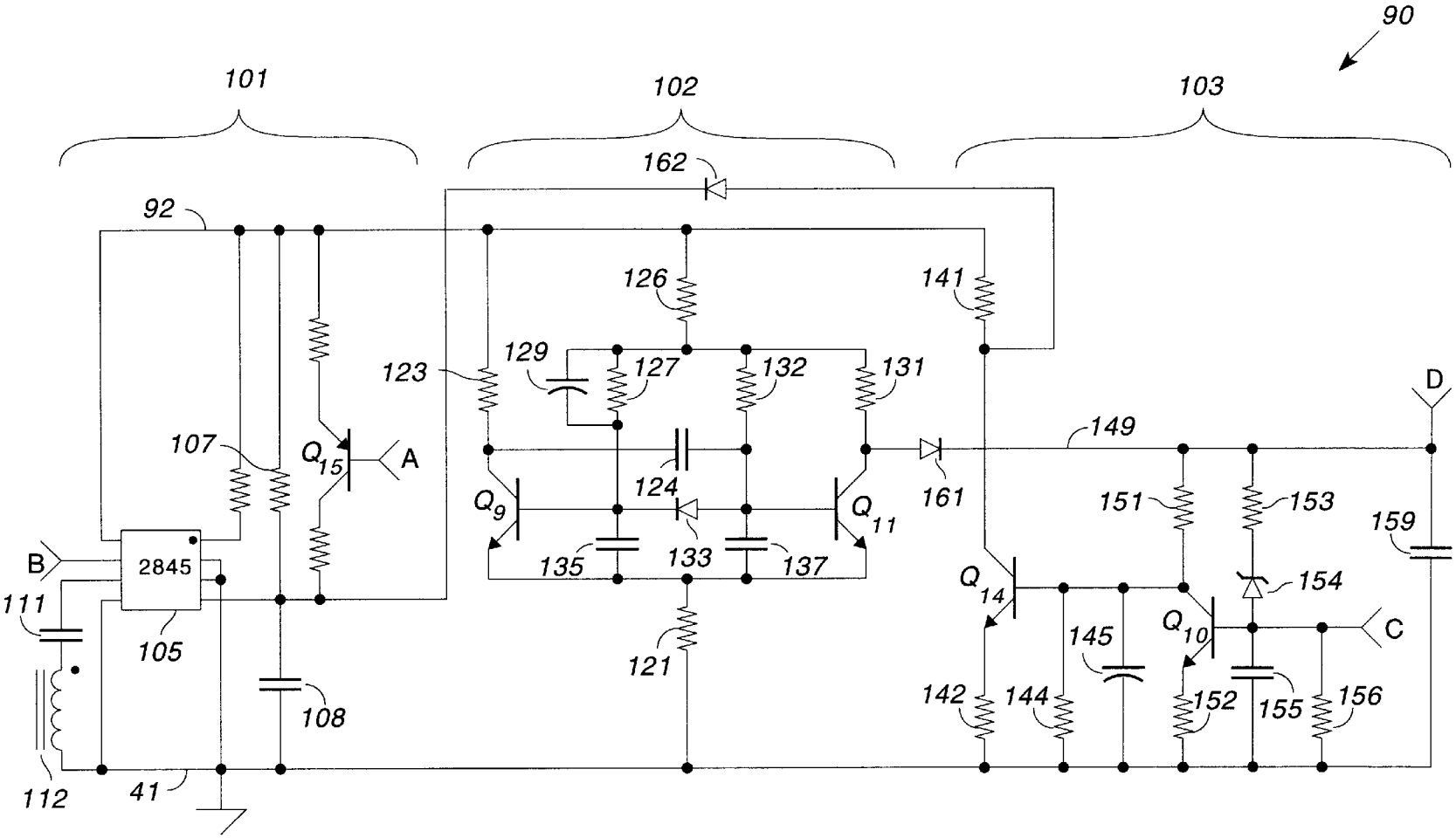
FIG. 2 is a schematic of the control circuit illustrated in block form in FIG. 1.

FIG. 2 is a schematic of control circuit 90. Inputs A, B, C, and D of FIG. 2 connect to lines A, B, C, and D of FIG. 1. Control circuit 90 includes driver section 101, multivibrator section 102, and sensing section 103.

In driver section 101, PWM circuit 105 is powered from line B and produces a local, regulated output voltage that drives rail 92 to approximately five volts. In one embodiment of the invention, PWM circuit 105 was a 2845 pulse width modulator circuit. Pin 1 of PWM circuit 105 is indicated by a dot and the pins are numbered consecutively clockwise. The particular chip used to implement the invention included several capabilities that are not needed, i.e. the invention can be implemented with a much simpler integrated circuit such as a 555 timer chip.

Pin 1 of PWM circuit 105 relates to an unneeded function and is tied high. Pins 2 and 3 relate to unneeded functions and are grounded. Pin 4 is the frequency setting input and is connected to the junction of resistor 107 and capacitor 108. Pin 5 is electrical ground for PWM circuit 105 and is connected to rail 41. Pin 6 of PWM circuit 105 is the high frequency output and is coupled through capacitor 111 to inductor 112. Inductor 112 is magnetically coupled to inductor 78 and to inductor 79 (FIG. 1). As indicated by the small dots adjacent each inductor, inductors 78 and 79 are oppositely poled, thereby causing transistors $Q_5$ and $Q_6$ to switch alternately at a frequency determined by resistor 107, capacitor 108, and the voltage on rail 92.

Pin 7 of PWM circuit 105 is connected to line B, the low voltage output of the boost circuit in FIG. 1. Pin 8 of PWM circuit 105 is a voltage output for providing bias to the frequency determining network including resistor 107 and capacitor 108, which are series-connected between rail 92 and rail 41. Pin 8 is connected to rail 92 to provide voltage for the circuitry illustrated in FIG. 2. Transistor $Q_{15}$ is connected in parallel with resistor 107 and the base of transistor is coupled to line A.

In multivibrator section 102, $Q_9$ and $Q_{11}$ are interconnected between rails 92 and 41, sharing common emitter resistor 121. The collector of transistor $Q_9$ is coupled to rail 92 by resistor 123 and is coupled to the base of transistor $Q_{11}$ by capacitor 124. The base of transistor $Q_9$ is coupled to rail 92 through resistors 126 and 127. Capacitor 129 is connected in parallel with resistor 127. The collector of transistor $Q_{11}$ is coupled to rail 92 through resistor 131 and resistor 126 and the base of transistor $Q_{11}$ is connected to rail 92 through resistors 132 and 126. The bases of transistors $Q_9$ and $Q_{11}$ are interconnected by diode 133 and are coupled to resistor 121 by capacitors 135 and 137.

Sensing section 103 includes transistor $Q_{14}$ coupled to low voltage rail 92 by resistor 141 and to common by resistor 142. The base of transistor $Q_{14}$ is coupled to the collector of transistor $Q_{10}$. An RC network including resistor 144 and capacitor 145 is connected between the base of transistor $Q_{14}$ and common. Transistor $Q_{10}$ is coupled to summation node 149 by resistor 151 and to common by resistor 152. The base of transistor $Q_{10}$ is coupled to summation node 149 by resistor 153 and Zener diode 154. The base of transistor $Q_{10}$ is also coupled to input C. An RC network including resistor 155 and capacitor 156 is coupled between input C and common. Diode 161 couples (when conducting) or isolates (when non-conducting) the collector of transistor $Q_{11}$ and summation node 149. Diode 162 is coupled between the collector of transistor $Q_{14}$ and pin 4 of PWM circuit 105.

When power is applied to the ballast, the boost circuit produces both a high voltage output and a low voltage output. The low voltage output is coupled by line B to PWM circuit 105, which powers rail 92 and produces signals for switching transistors $Q_5$ and $Q_6$ (FIG. 1). When rail 92 is charged, current flows through resistor 126 and capacitor 129 to the base of transistor $Q_9$, turning on $Q_9$. Current also flows through resistor 131, diode 161, and resistor 151 to charge capacitor 145. After approximately fifty milliseconds, transistor $Q_{14}$ conducts, back biasing diode 162 and causing the frequency of the signal from PWM circuit 105 to decrease. The output voltage from the ballast increases correspondingly as the frequency approaches resonance.

If There Is No Lamp

At a peak voltage of approximately 1400 volts, as determined by resistors 82 and 85 (FIG. 1) and resistor 156, $Q_{10}$ starts to conduct, reducing the charging of capacitor 145 and causing transistor $Q_{14}$ to conduct less. This holds the output voltage constant and the frequency of the inverter is constant.

Transistor $Q_{11}$ remains off while capacitors 124 and 137 charge through resistors 132 and 126. Eventually enough charge accumulates and transistor $Q_{11}$ conducts, shutting off transistor $Q_9$. The rise in collector voltage on transistor $Q_9$ is coupled through capacitor 124 to increase conduction in transistor $Q_{11}$. A rapid transition takes place, leaving $Q_{11}$ fully conducting and $Q_9$ fully off. With $Q_{11}$ conducting, transistor $Q_{14}$ is turned off, increasing the output frequency and decreasing the output voltage.

After a few seconds, as determined by the discharging of capacitor 129 by resistor 127, transistor $Q_9$ turns on again and the regenerative action of the multivibrator turns off transistor $Q_{11}$. The frequency increases as described above. The high voltage is maintained for about ten milliseconds, as determined by capacitor 124 and resistor 132, thereby providing an output signal having a trapezoidal envelope. Note that the output voltage does not increase to some voltage and then abruptly drop during starting, producing an output voltage with a sawtooth envelope. In accordance with the invention, the output voltage has a trapezoidal envelope.

In accordance with another aspect of the invention, the inverter changes frequency smoothly and continuously until a particular output voltage is reached, then the frequency and output voltage become constant. Resistor 126 limits the rate at which transistor $Q_9$ begins conducting, giving the boost circuit an additional twenty milliseconds to stabilize and to charge the bulk capacitors. Resistors 126, 142, 151, and 144 are a pulse shaping network that causes the output voltage to ramp up smoothly from zero volts to 1400 volts in no less than some minimum period, e.g. five milliseconds, stay at 1400 volts for a minimum period, e.g. eight milliseconds, and decrease smoothly to zero volts in no less than some minimum period, e.g. five milliseconds.

A smooth frequency change provides a significant advantage in that the ballast can adapt to changes in circuit values and to the effects of a lamp or a fixture, such as stray capacitance. This makes the ballast less expensive to manufacture and less "quirky" in the field. A series resonant, parallel loaded output means that the output voltage is dependent upon frequency. Simply driving an inverter at a preset frequency may not produce the desired output voltage because of variations in circuit components, particularly inductors but including resistors and capacitors. In accordance with the invention, the frequency is ramped until a voltage is reached. Therefore, the optimum frequency cannot be missed, as it could with a discontinuous frequency change.

If the Lamps Are Present

Referring to FIG. 1, when high voltage is applied to lamps 73 and 74, they conduct quickly, positively charging capacitor 81. The voltage on capacitor 81 is coupled by resistor 87 and diode 86 to line D. In FIG. 2, input D is coupled to summation node 149. The positive voltage on node 149 holds transistor $Q_{14}$ on as long as lamp current persists. The multivibrator continues to oscillate at a fraction of a hertz but this is of no effect because diode 161 is reverse biased.

If Power Is Interrupted

If the line voltage is interrupted, the voltage on line B decreases quickly and PWM circuit 105 shuts off. The positive side of capacitor 129 is pulled to ground potential and the negative side of the capacitor goes to several volts below ground. The base of transistor $Q_{11}$ is pulled to a negative bias through diode 133, where it is held by capacitor 137. The reverse bias on the base-emitter junction of transistor $Q_{11}$ assures that, when line voltage is restored, the full output voltage is applied to the lamp regardless of the charge on capacitor 129. This gives the ballast good immunity to voltage dips. Without diode 133, an indeterminate delay of up to three seconds could be involved while the ballast waited for the next cycle of the multivibrator.

Lamps at End of Life

If a lamp begins to rectify such that the right hand side of capacitor 81 (FIG. 1) becomes more positive than normal, Zener diode 154 conducts, turning on transistor $Q_{10}$. Turning on $Q_{10}$ turns off transistor $Q_{14}$ and increases the frequency of the inverter, thereby decreasing the power supplied to the lamp. If the lamp begins to rectify such that the right hand side of capacitor 81 is less positive than normal or becomes negative, then node 149 become unlatched (diode 161 conducts) and the ballast will switch to high frequency mode, producing a voltage pulse every few seconds. A lesser degree of rectification will produce a frequency increase and dimming.

Lamp Leakage

If either lamp is not connected to the ballast, capacitor 81 will not become charged and a confirming signal will not be sent on line D indicating that a lamp is present.

Arc Quenching

In FIG. 1, if there is a loose connection between a socket and a pin of one of the lamps, and an arc strikes across the gap, or to ground, the output voltage increases substantially and some current flows through the by-pass capacitor in parallel with the loose lamp. The voltage from inductor 88 also increases. If the output voltage is being pulsed, the voltage on capacitor 62 does not increase very much because the pulses are short, approximately ten milliseconds each. When there is an arc, the output voltage is increased for much longer than ten milliseconds and the voltage on capacitor 62 increases significantly. At some point, Zener diode 75 conducts, turning on transistor $Q_2$ and turning off the boost circuit. In one embodiment of the invention, diode 75 is rated at twenty-four volts. The voltage on capacitor 62 is approximately twenty volts during normal operation of the ballast. The ballast tries to restart, producing a pulse every few seconds. The result is that any arc is quickly extinguished before enough power is dissipated to start a fire.

The invention thus provides a low cost, compact, efficient, ballast for gas discharge lamps. The ballast includes a self-oscillating, variable frequency boost circuit, a driven inverter having a series resonant, direct coupled output, and a low voltage control circuit for driving the inverter and responding to fault conditions. The ballast illustrated in FIGS. 1 and 2 can supply at least sixty watts to a load at an efficiency of approximately ninety-two percent and a total harmonic distortion of the input line current of about six percent.

Having thus described the invention, it will be apparent to those of skill in the art that various modifications can be made within the scope of the invention. For example, a boost-type power factor correction stage can be replaced by a buck boost or other type converter. The series resonant output inductor could be constructed as two windings on the same core, with the resonant capacitor connected between them. The switching transistors of the half-bridge inverter can be driven by solid state level shifters or opto-isolators instead of transformers. A self-oscillating inverter could also be used. Although intended for instant start lamps, a ballast constructed in accordance with the invention can be used to power gas discharge lamps with heaters. It is understood that reference to a "trapezoidal" envelope does not mean a precise geometric figure but refers to the general shape of the waveform on an oscilloscope, e.g. corners are rounded, not pointed, and lines may not be perfectly straight.

What is claimed as the invention is:

1. An electronic ballast for powering a gas discharge lamp, said ballast comprising:

an inverter having a series resonant output including a first inductor and a first capacitor connected in series;

control means for driving said inverter at an adjustable frequency; and a second inductor, magnetically coupled to said first inductor, for supplying power to said control means.

2. The ballast as set forth in claim 1 and further including:

a converter for converting an AC input voltage into pulses of direct current at a high voltage and for converting said AC input voltage into a direct current at a low voltage;

wherein said direct current at low voltage also supplies power to said control means.

3. The ballast as set forth in claim 1 wherein said output is a direct coupled output.

4. The ballast as set forth in claim 1 and further including a second capacitor and a diode; wherein said second inductor includes a first end and a second end, said first end is connected to a common point, said second end is coupled by said diode to said second capacitor, and said second capacitor is coupled to a supply input of said control means.

5. The ballast as set forth in claim 4 and further including a zener diode coupled to said second capacitor.

6. The ballast as set forth in claim 5 and further including an NPN transistor, wherein said zener diode is coupled to the base of said NPN transistor.

7. The ballast as set forth in claim 6 and further including:

a converter for converting an AC input voltage into pulses of direct current at a high voltage and for converting said AC input voltage into a direct current at a low voltage;

wherein said direct current at low voltage also supplies power to said control means; and wherein said converter includes said NPN transistor and said NPN transistor controls the frequency of said pulses.

8. An electronic ballast for powering a gas discharge lamp, said ballast comprising:

a half-bridge inverter having a series resonant output for connection to said lamp;

sense means coupled to said inverter and to said output for detecting a DC voltage across said lamp and for increasing the frequency of said inverter when the DC voltage is detected, whereby said lamp is dimmed at end of life.

9. The ballast as set forth in claim 8 wherein said sense means includes a zener diode for defining a threshold voltage that said DC voltage must exceed before the sense means increases the frequency of the inverter.

10. The ballast as set forth in claim 8 wherein said output is a direct coupled output.

11. An electronic ballast for powering a gas discharge lamp, said ballast comprising:

an inverter having a series resonant output including a first inductor and a capacitor connected in series;

control means for driving said inverter at an adjustable frequency;

a second inductor, magnetically coupled to said first inductor, for supplying power to said control means; and sense means coupled to said inverter and to said output for detecting a DC voltage across said lamp and for increasing the frequency of said inverter when a DC voltage is detected.

12. The ballast as set forth in claim 11 and further including:

a converter for converting an AC input voltage into pulses of direct current at a high voltage and for converting said AC input voltage into a direct current at a low voltage;

wherein said direct current at low voltage also supplies power to said control means.

* * * * *